US009821451B1

(12) United States Patent
Kao

(10) Patent No.: US 9,821,451 B1
(45) **Date of Patent: *Nov. 21, 2017**

(54) TOOL HOLDING FRAME

(71) Applicant: Jui-Chien Kao, Taichung (TW)

(72) Inventor: Jui-Chien Kao, Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 15/401,322

(22) Filed: Jan. 9, 2017

(30) Foreign Application Priority Data

Dec. 21, 2016 (TW) ..... 105142469 A

(51) Int. Cl.
*B25H 3/00* (2006.01)
*B25H 3/04* (2006.01)

(52) U.S. Cl.
CPC ..... *B25H 3/003* (2013.01); *B25H 3/04* (2013.01)

(58) Field of Classification Search
CPC . B25H 3/04; B25H 3/06; B25H 3/003; B25H 3/006; B25H 3/00; A47F 7/0028; A47F 5/0846; A47F 5/0853; A47F 5/0838; B25B 13/56
USPC ..... 211/70.6, 69, 94.01, DIG. 1, 66, 70.8, 211/89.01, 162; 206/378, 349, 373, 376, 206/350, 443, 818, 372
See application file for complete search history.

(56) References Cited

U.S. PATENT DOCUMENTS

| | | | | |
|---|---|---|---|---|
| 8,517,188 | B2 * | 8/2013 | Kao | B25H 3/06 211/70.6 |
| 9,186,790 | B1 * | 11/2015 | Kao | B25H 3/06 |
| 9,522,467 | B1 * | 12/2016 | Kao | A47F 7/0028 |
| 9,538,862 | B2 * | 1/2017 | Kao | A47F 5/08 |
| 9,539,721 | B1 * | 1/2017 | Kao | B25H 3/003 |
| 9,662,781 | B1 * | 5/2017 | Kao | B25H 3/003 |
| 9,694,491 | B1 * | 7/2017 | Kao | B25H 3/04 |
| 2003/0019775 | A1 * | 1/2003 | Ernst | B25H 3/003 206/378 |
| 2012/0138553 | A1 * | 6/2012 | Kao | B25H 3/06 211/70.6 |
| 2015/0336262 | A1 * | 11/2015 | Kao | B25H 3/06 206/378 |
| 2016/0096264 | A1 * | 4/2016 | Kao | B25H 3/06 206/378 |

* cited by examiner

*Primary Examiner* — Stanton L Krycinski
*Assistant Examiner* — Hiwot Tefera
(74) *Attorney, Agent, or Firm* — Rosenberg, Klein & Lee

(57) ABSTRACT

A tool holding frame has a track base, a positioning board, and at least one positioning mount. The track base has a bottom panel and two rails. Each rail has a sliding channel. The positioning board is disposed on the track base and has multiple positioning segments and multiple first engaging segments. Each positioning segment has a curved positioning groove. The first engaging segments are arranged alternately with the positioning segments. The at least one positioning mount is slidably and rotatably mounted on the track base. Each positioning mount has an annular positioning flange and multiple second engaging segments. A curved part of the positioning flange is selectively engaged with one of the positioning segments. Two of the second engaging segments are selectively engaged with one of the first engaging segments.

9 Claims, 12 Drawing Sheets

TOOL HOLDING FRAME

BACKGROUND OF THE INVENTION

1. Field of the Invention

The present invention relates to a tool holding frame, and more particularly to a tool holding frame that may provide a firm positioning effect in rotation and movement to tools that are mounted on the tool holding frame.

2. Description of Related Art

A conventional socket holding frame has a track base and multiple positioning mounts slidably mounted on the track base. The positioning mounts are used to hold sockets on the track base to allow a user to look for the marks of sizes or model numbers on outer peripheries of the sockets by rotating the sockets. To move or rotate the sockets easily and quickly, the track base is not set up with any fixing structure for fixing the positioning mounts with the track base. Hence, the positioning mounts may be moved or rotated by impact or hit by an unexpected force, such that the user has to frequently and repeatedly look for the marks of sizes or model numbers of the sockets, which is very inconvenient in use.

With reference to FIG. 12, a conventional socket holding frame comprises a track base 80 and multiple positioning mounts 82 positioned relative to the track base 80 in movement and rotation. Multiple protrusions are formed on the track base 80, are aligned in a line, and are selectively engaged with multiple teeth formed on a bottom of each positioning mount 82 to hold the positioning mount 82 in position relative to the track base 80. However, the engagement between the protrusions and the teeth of the conventional socket holding frames is insufficient to firmly hold the positioning mounts 82 in position.

To overcome the shortcomings of the conventional socket holding frame, the present invention provides a tool holding frame to mitigate or obviate the aforementioned problems.

SUMMARY OF THE INVENTION

The present invention relates to a tool holding frame, and more particularly to a tool holding frame that can provide a firm positioning effect in movement and rotation to tools that are mounted on the tool holding frame.

The tool holding frame has a track base, a positioning board, and at least one positioning mount. The track base has a bottom panel and two rails. The bottom panel is elongated and has a top surface. The two rails are disposed respectively on two sides of the top surface of the bottom panel. Each one of the two rails has a sliding channel having an opening, and the two openings of the two sliding channels of the two rails face each other. The positioning board is disposed on the track base and has two long opposite sides, a middle, a top surface, multiple positioning segments, and multiple first engaging segments. The multiple positioning segments are formed on the top surface of the positioning board at spaced intervals, and are aligned in a straight line. Each positioning segment has a curved positioning groove. The multiple first engaging segments are formed on and protrude from the top surface of the positioning board, are aligned in a straight line, and are arranged alternately with the positioning segments, The at least one positioning mount is slidably and rotatably mounted on the track base. Each one of the at least one positioning mount has a sliding seat and an extending element. The sliding seat is slidably and rotatably mounted in the sliding channels of the rails and has a bottom, a top, an annular positioning flange, multiple second engaging segments, and a guiding groove. The annular positioning flange is formed on and protrudes downwardly from the bottom of the sliding seat and has a part selectively engaging with the curved engaging groove of one of the positioning segments on the positioning board. The multiple second engaging segments are formed on the bottom of the sliding seat at spaced intervals and are arranged annularly. Adjacent two of the multiple second engaging segments are selectively engaged with one of the multiple first engaging segments on the positioning board. The guiding groove is defined in and extends diametrically through the bottom of the sliding seat. The extending element is formed on and protrudes upwardly from the top of the sliding seat.

Other objects, advantages, and novel features of the invention will become more apparent from the following detailed description when taken in conjunction with the accompanying drawings.

DETAILED DESCRIPTION OF PREFERRED EMBODIMENT

Figure 1:
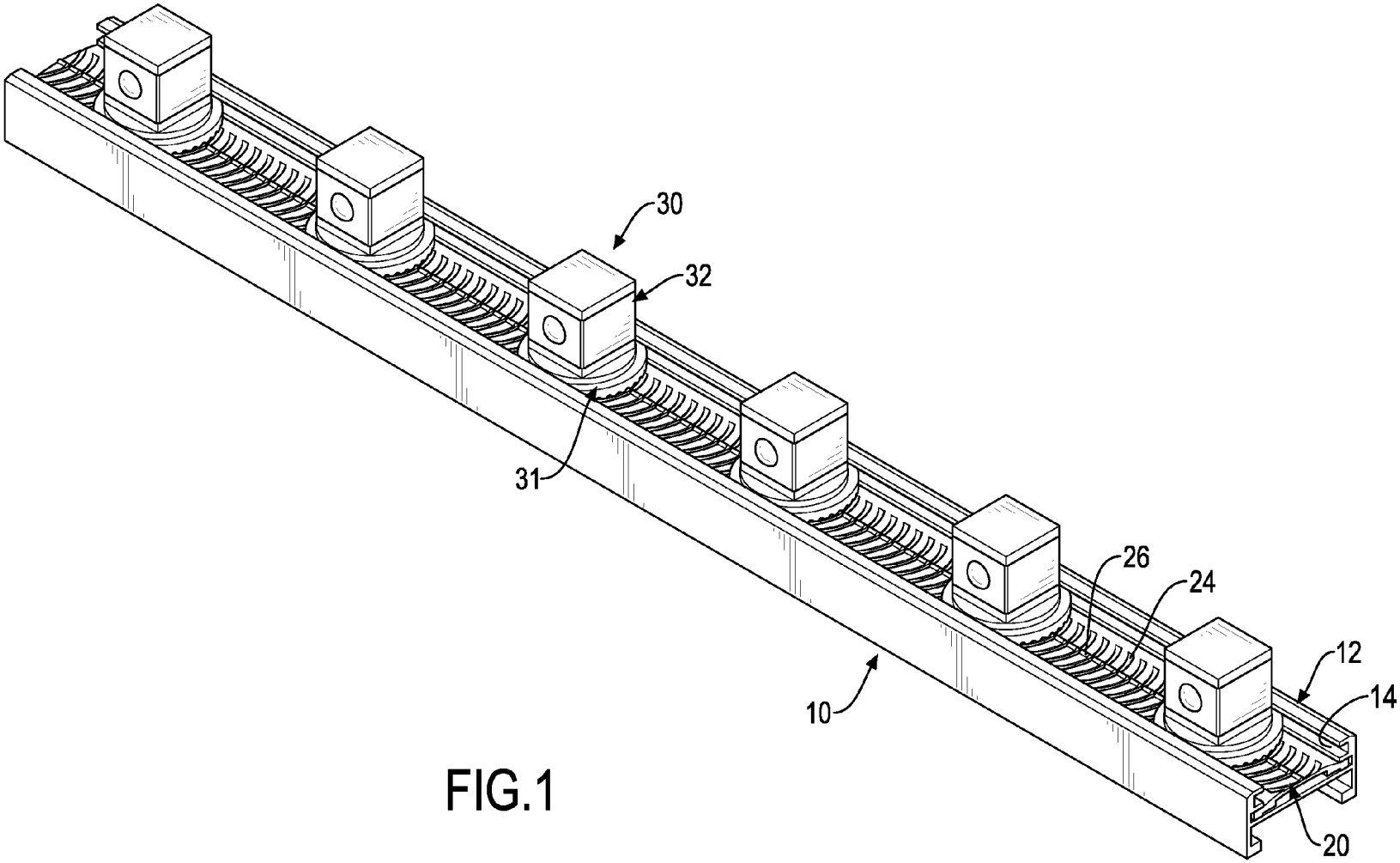
FIG. 1 is a perspective view of a tool holding frame in accordance with the present invention.
Figure 2:
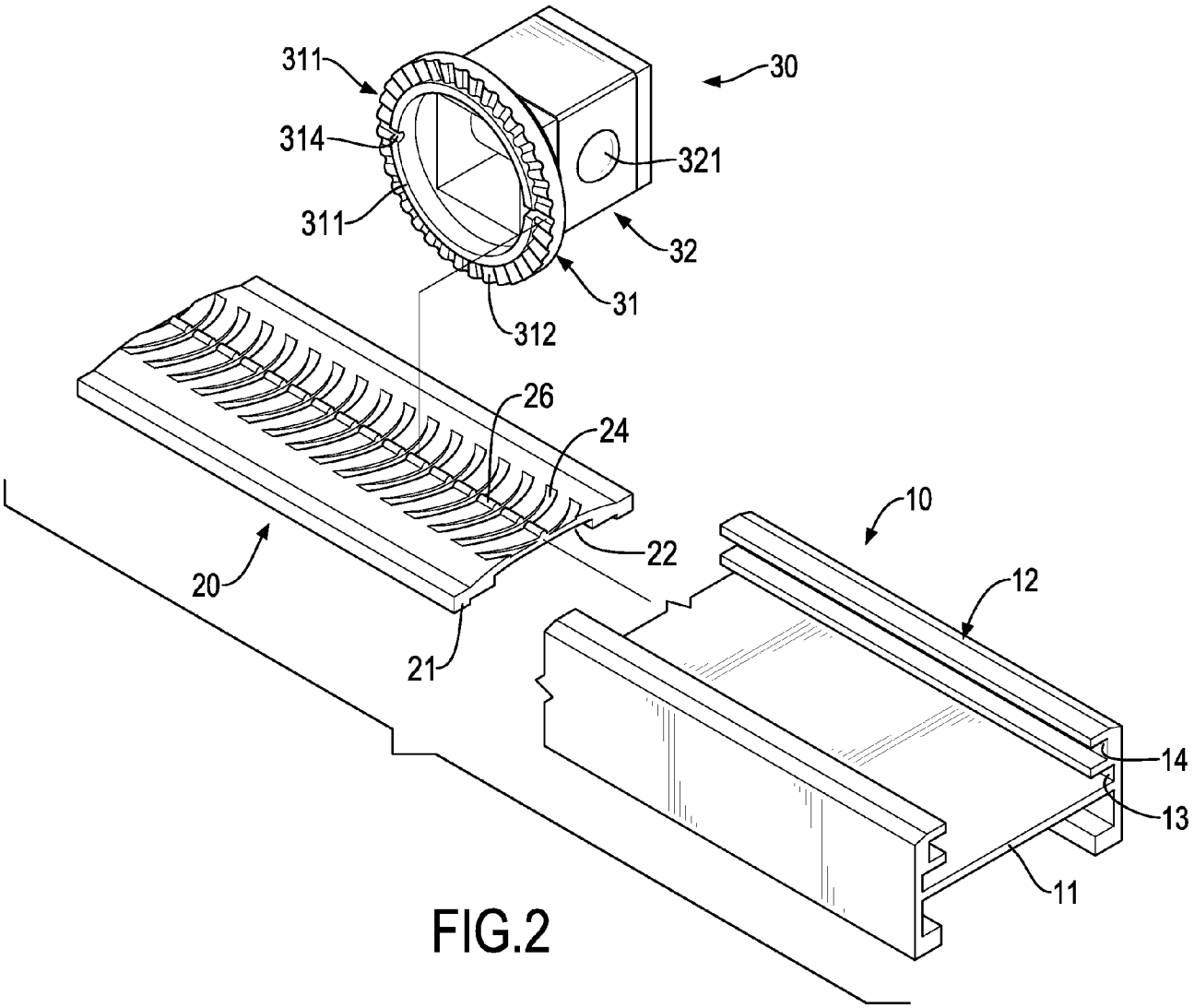
FIG. 2 is an enlarged exploded perspective view of the tool holding frame in FIG. 1.
Figure 3:
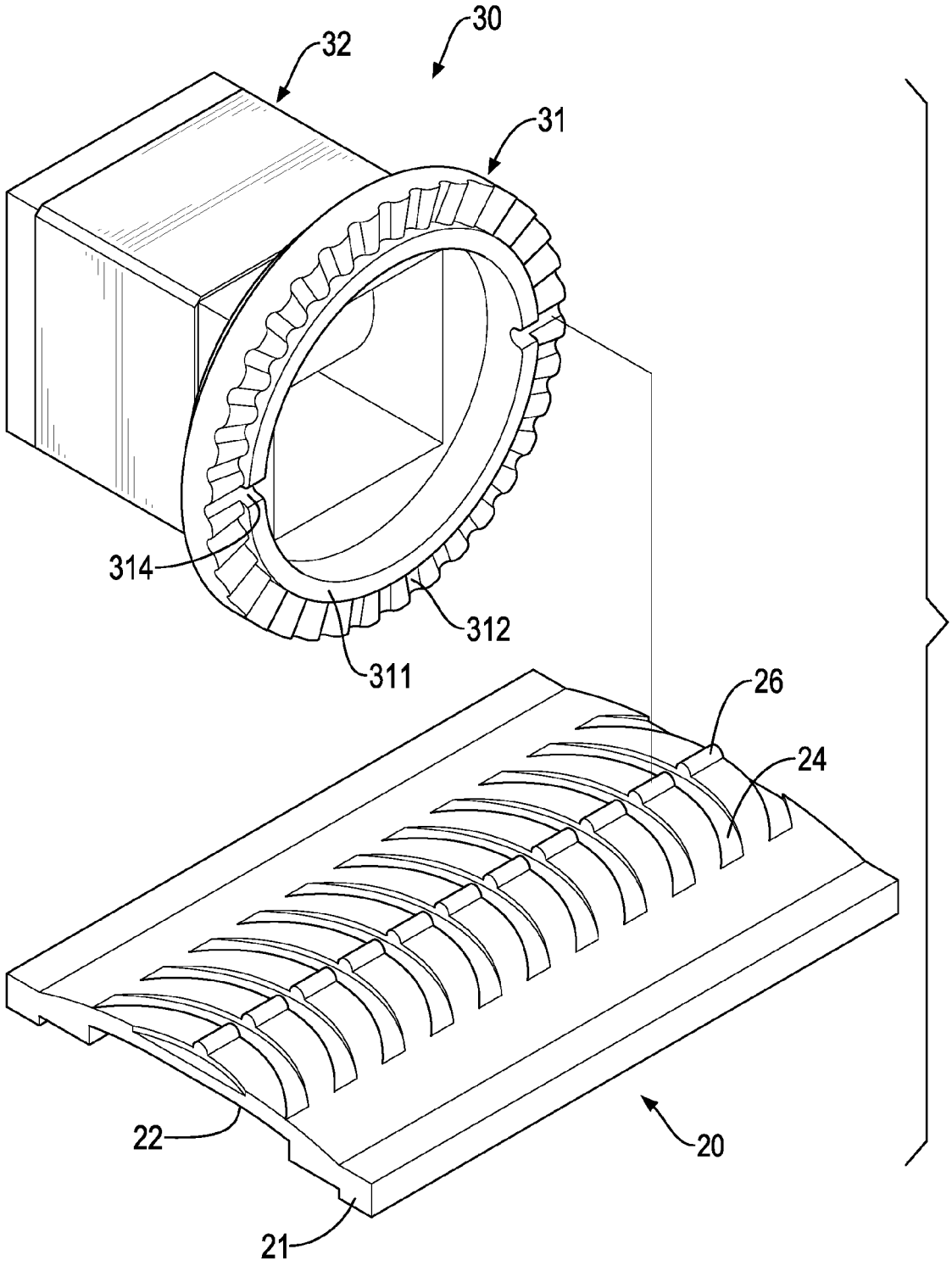
FIG. 3 is another enlarged exploded perspective view of the tool holding frame in FIG. 1.
Figure 4:
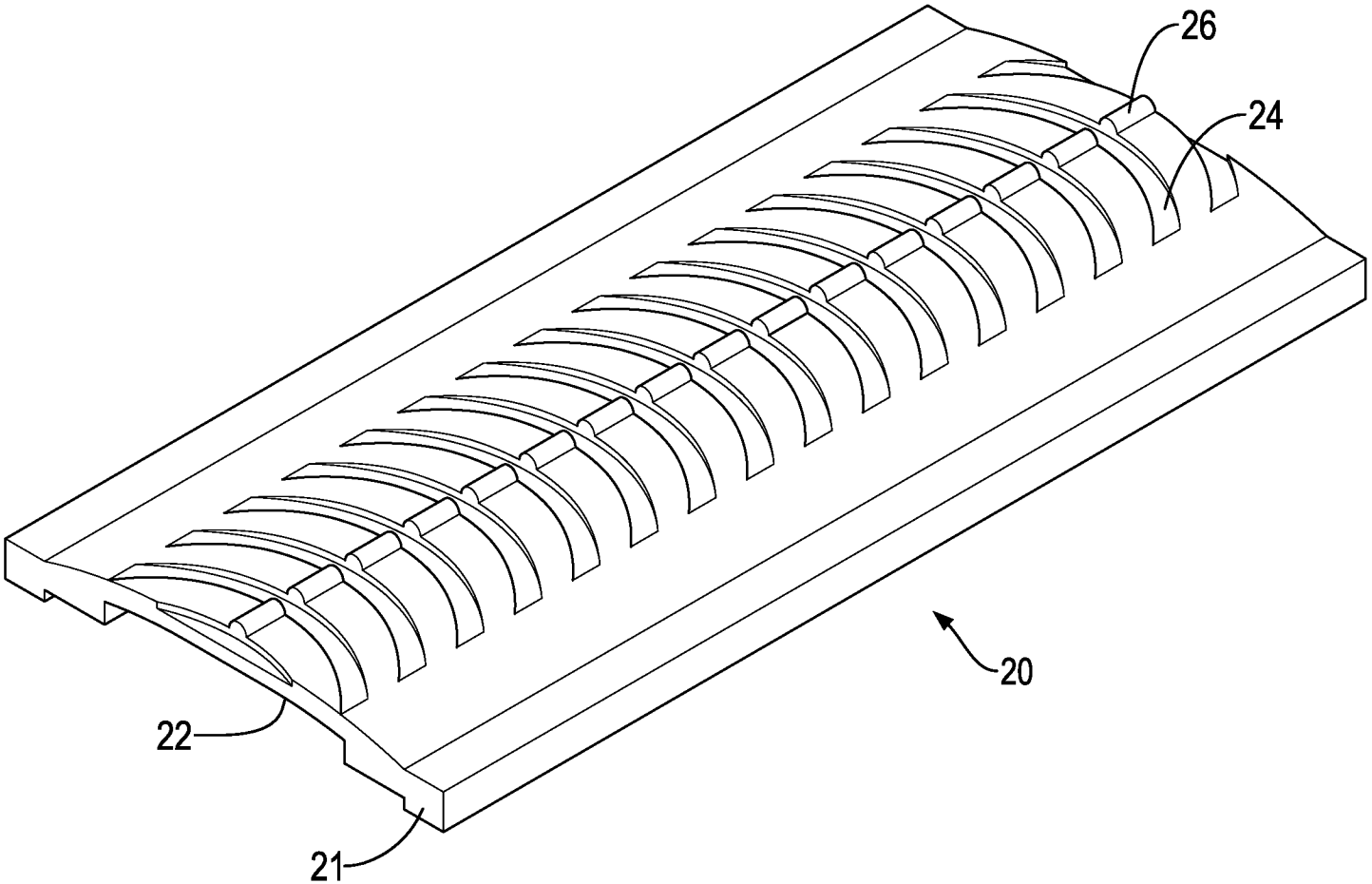
FIG. 4 is an enlarged partial perspective view of the positioning board of the tool holding frame in FIG. 1.

With reference to FIGS. 1 to 4, a tool holding frame in accordance with the present invention comprises a track base 10, a positioning board 20, and at least one positioning mount 30.

The track base 10 is elongated, is made of metal, and is preferably an aluminum extrusion. The track base comprises a bottom panel 11 and two rails 12. The bottom panel 11 is elongated and has a top surface. The two rails 12 are respectively formed on and protrude from two sides of the top surface of the bottom panel 11. Each rail 12 has a sliding channel 14 and a positioning channel 13. Each one of the sliding channels 14 and the positioning channels 13 has an opening. The openings of the sliding channels 14 face each other and the openings of the positioning channels 13 also face each other. The positioning channel 13 of each rail 12 is located below the sliding channel 14 of the rail 12.

The positioning board 20 is resilient, is mounted in the positioning channels 13 in the rails 12 of the track base 10, and has two long opposite sides, two free ends, a middle, a top surface, a bottom surface, two rail bars 21, a recess 22, multiple positioning segments 24, and multiple first engaging segments 26. The positioning board 20 is bent upwardly from the long opposite sides to the middle of the positioning board 20. The two rail bars 21 are formed on and protrude outwardly from the bottom surface of the positioning board 20 respectively at the two long opposite sides of the positioning board 20 and are mounted respectively in the positioning channels 13 of the rails 12. The recess 22 is formed in the bottom surface at the middle of the positioning board 20 between the free ends of the positioning board 20, and is parallel with the long opposite sides of the positioning board 20 to define a space between the middle of the positioning board 20 and the top surface of the bottom panel 11. The space allows the positioning board 20 to be deformed relative to the track base 10. Alternatively, the positioning board 20 may be formed integrally with the track base 10 as a single piece.

The multiple positioning segments 24 are formed on the top surface of the positioning board 20 at spaced intervals between the two free ends of the positioning board 20. The positioning segments 24 are aligned in a straight line and are formed at the middle of the top surface of the positioning board 20. Each one of the multiple positioning segments 24 has a curved positioning groove. Preferably, the curved positioning groove has a depth gradually increasing from two ends to the middle of the curved positioning groove. The first engaging segments 26 are formed on and protrude from the top surface of the positioning board 20 at spaced intervals and are aligned in a straight line. The first engaging segments 26 are alternately arranged with the multiple positioning segments 24, and this means that each first engaging segment 26 is arranged between adjacent two of the positioning segments 24. Preferably, each first engaging segment 26 is arranged between middle positions of two adjacent positioning segments 24.

The at least one positioning mount 30 is slidably and rotatably mounted on the track base 10, and each one of the at least one positioning mount 30 has a sliding seat 31 and an extending element 32. The sliding seat 31 is round and resilient and is slidably and rotatably mounted in the sliding channels 14 in the rails 12. The sliding seat 31 has a bottom, a top, an annular positioning flange 311, multiple second engaging segments 312, and a guiding groove 314. The annular positioning flange 311 is formed on and protrudes downwardly from the bottom of the sliding seat 31 and has a curved part selectively engaged with the curved positioning groove of one of the positioning segments 24. The multiple second engaging segments 312 are continuously formed on the bottom of the sliding seat 31 at spaced intervals, are arranged annularly, and are arranged around an inner or outer periphery of the positioning flange 311. Adjacent two of the multiple second engaging segments 312 are engaged with one of the first engaging segments 26. The guiding groove 314 is defined in and extends diametrically through the bottom of the sliding seat 31

The extending element 32 is formed on and protrudes upwardly from the top of the sliding seat 31. Furthermore, the extending element 32 of each one of the at least one positioning mount 30 is an insertion button. The extending element 32 is hollow, is rectangular, and has a side surface and a protruding ball 321. The protruding ball 321 is mounted in and extends outwardly from the side surface of the insertion button.

Figure 5:
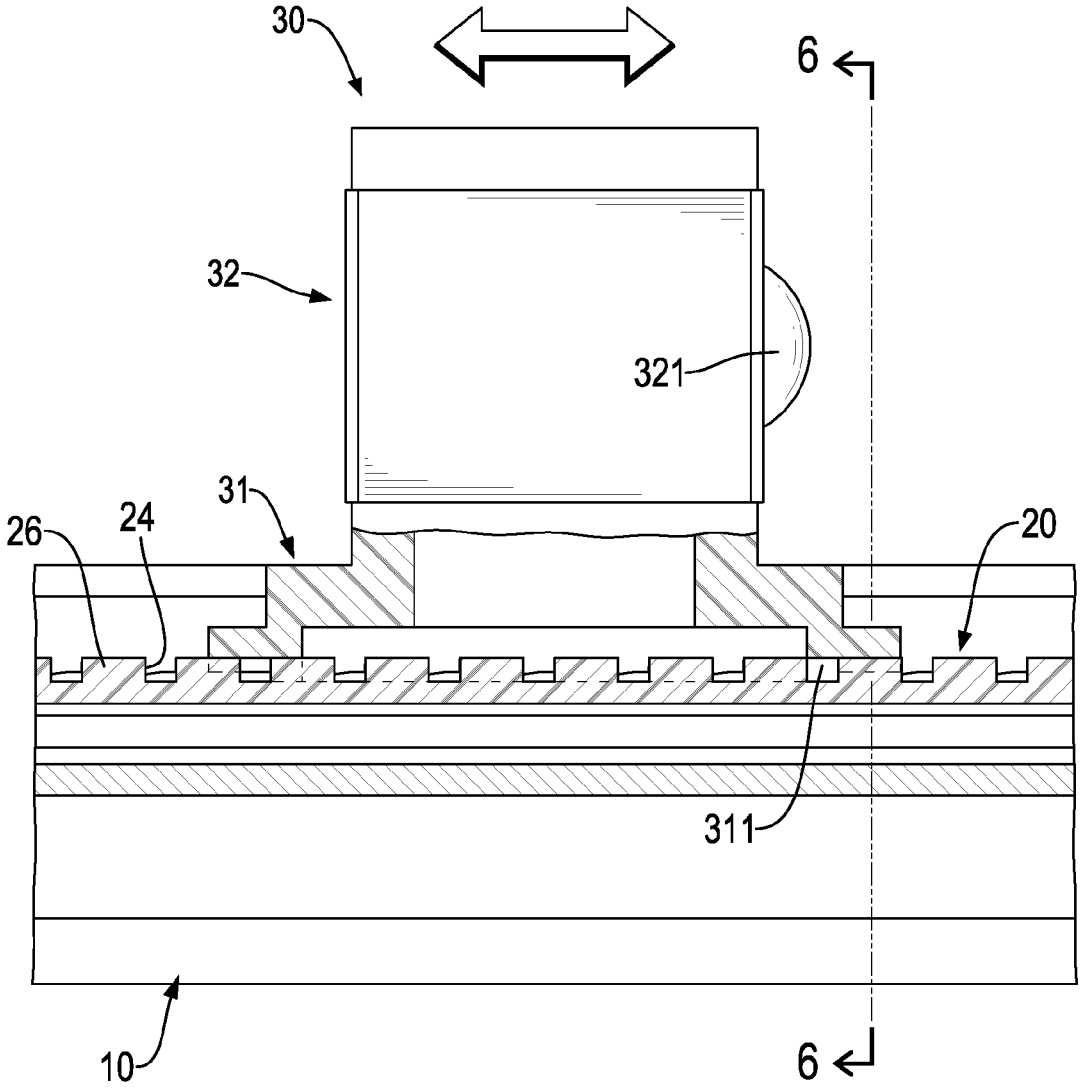
FIG. 5 is an enlarged front view in partial section of the tool holding frame in FIG. 1.
Figure 6:
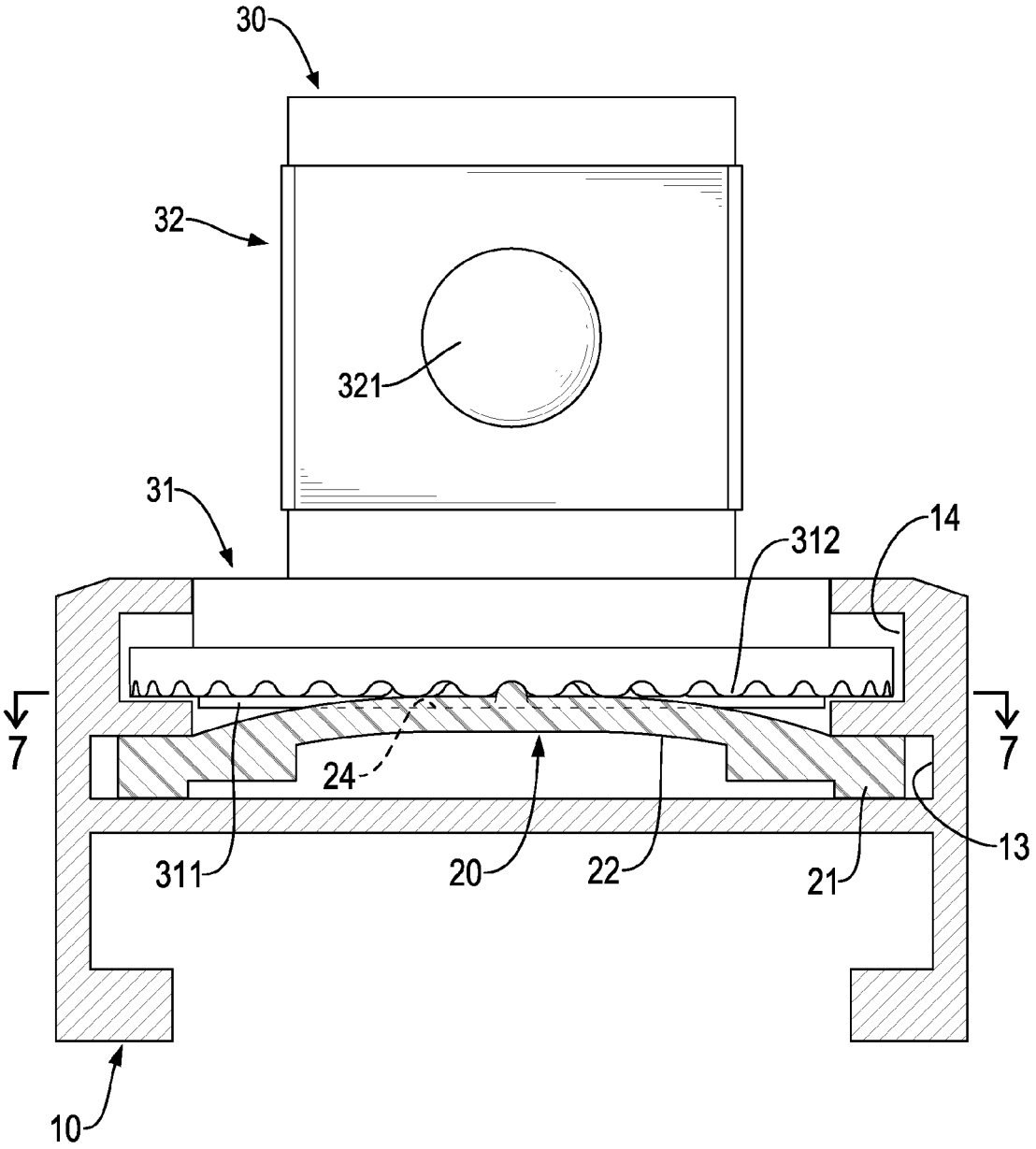
FIG. 6 is an end view in partial section of the tool holding frame along the line 6-6 in FIG. 5.
Figure 7:
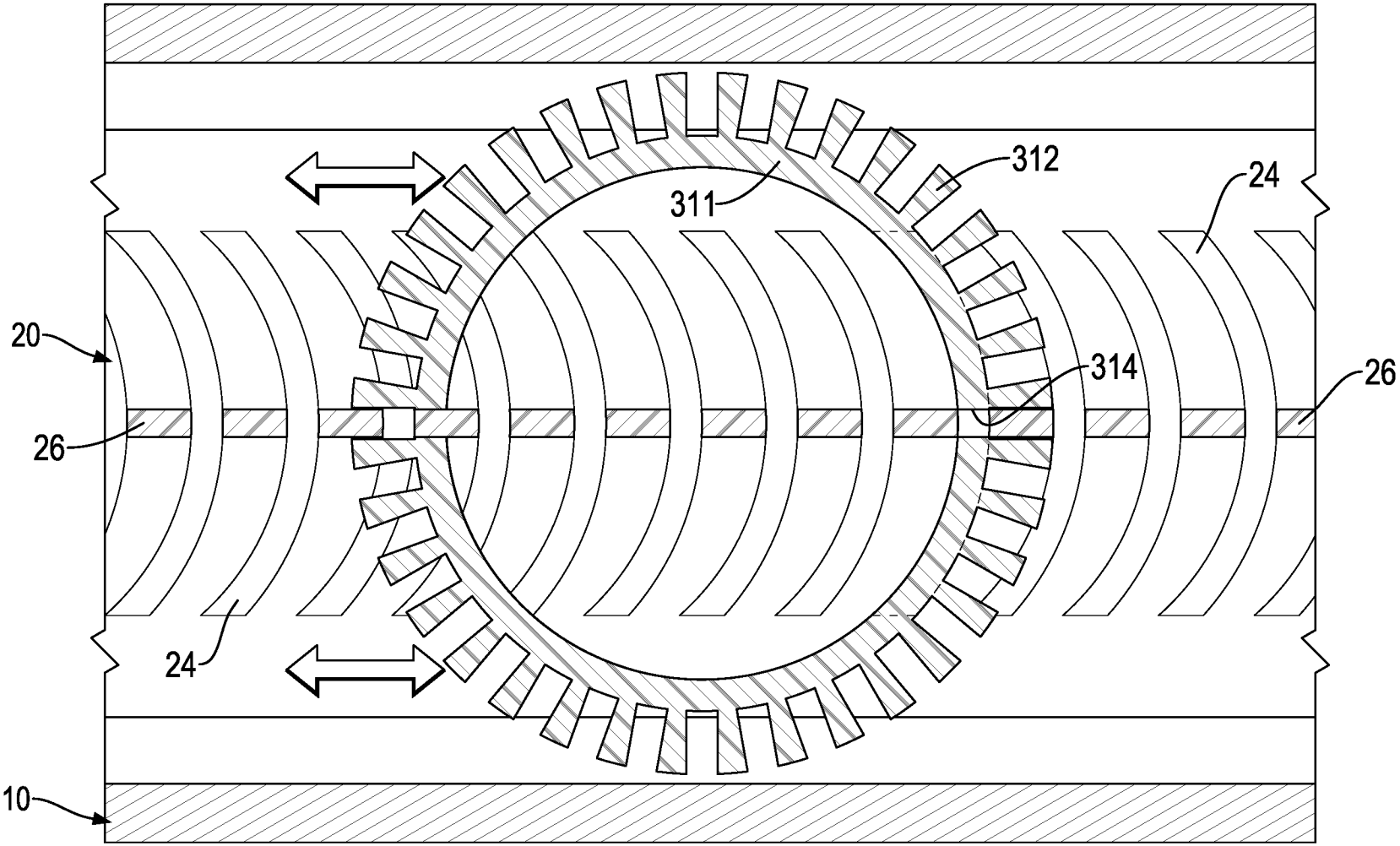
FIG. 7 is a top view in partial section of the tool holding frame along the line 7-7 in FIG. 6.

With reference to FIGS. 5 to 7, to dispose the positioning mount 30 onto the track base 10, the sliding seat 31 of the positioning mount 30 is inserted into the sliding channels 14 in the rails 12 from one of the ends of the track base 10. At this time, the guiding groove 314 in the positioning mount 30 is aligned with the first engaging segments 26 on the positioning board 20. Consequently, the positioning mount 30 can be slid smoothly and rapidly along the positioning board 20 to a desired position to engage the curved part of the annular positioning flange 311 with the curved positioning groove of one of the positioning segments 24. With the engagement between the curved part of the positioning flange 311 and the corresponding curved positioning groove, the positioning mount 30 can be firmly positioned at the desired position.

Figure 8:
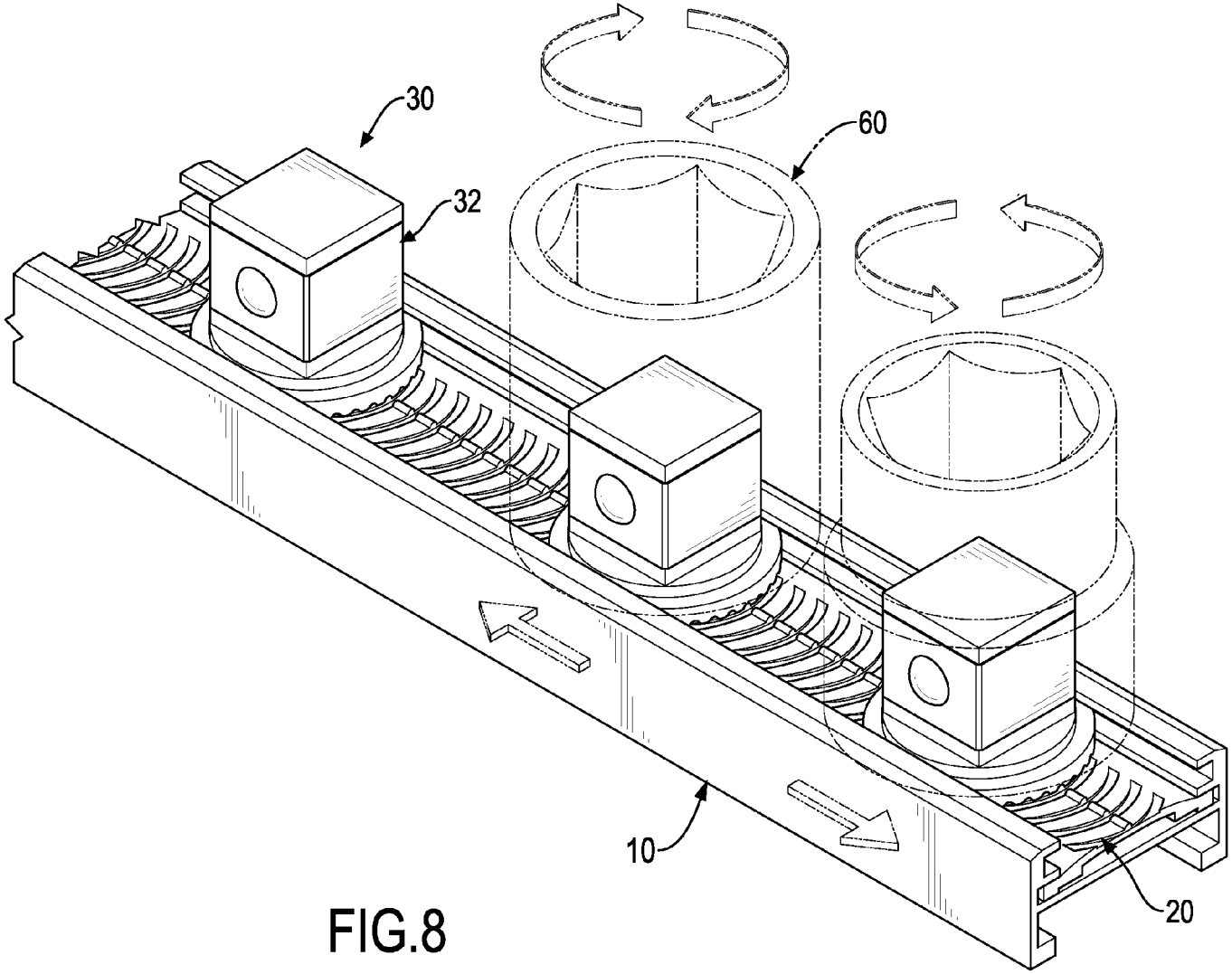
FIG. 8 is an operational perspective view of the tool holding frame in FIG. 1.

With reference to FIG. 8, multiple sockets 60 are respectively and detachably mounted around the extending elements 32 of the positioning mounts 30. When each socket 60 is mounted around the extending element 32 of a corresponding positioning mount 30, the protruding ball 321 of the extending element 32 is engaged with a recess in an inner wall of the socket 60. Consequently, the sockets 60 are positioned on the extending elements 32 of the positioning mounts 30.

Figure 9:
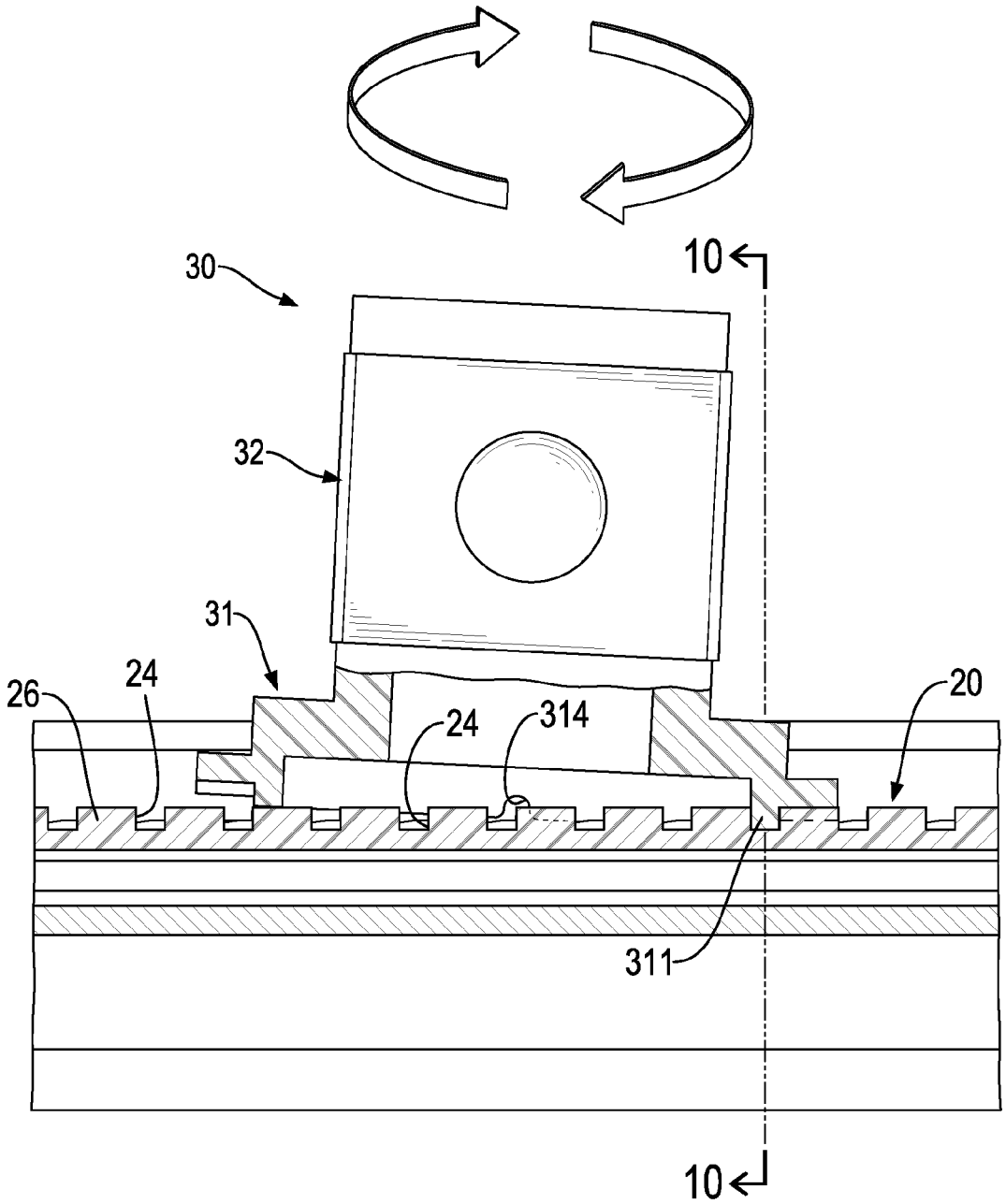
FIG. 9 is an enlarged operational front view in partial section of the tool holding frame in FIG. 1.
Figure 10:
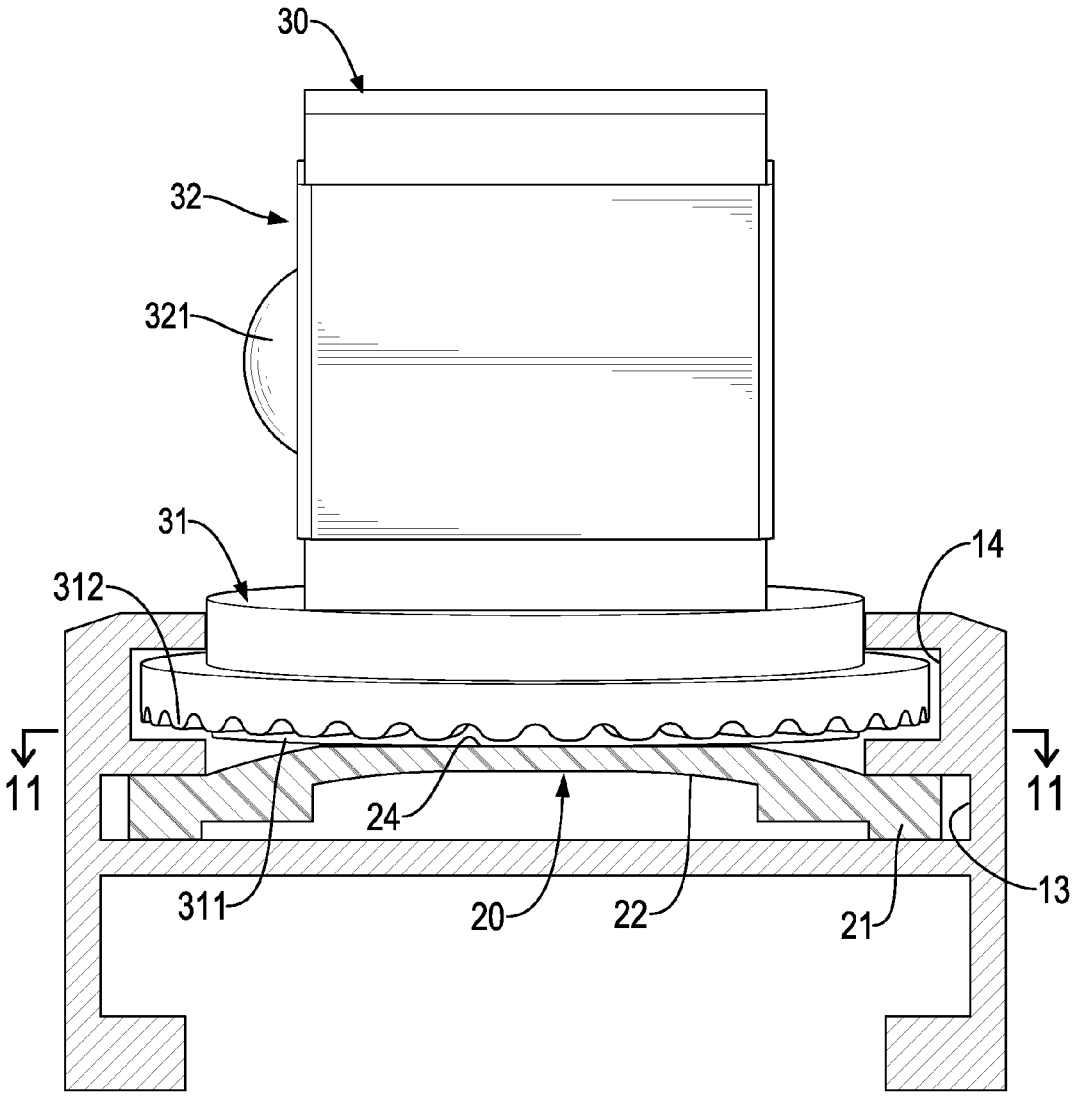
FIG. 10 is an operational end view in partial section of the tool holding frame along the line 10-10 in FIG. 9.
Figure 11:
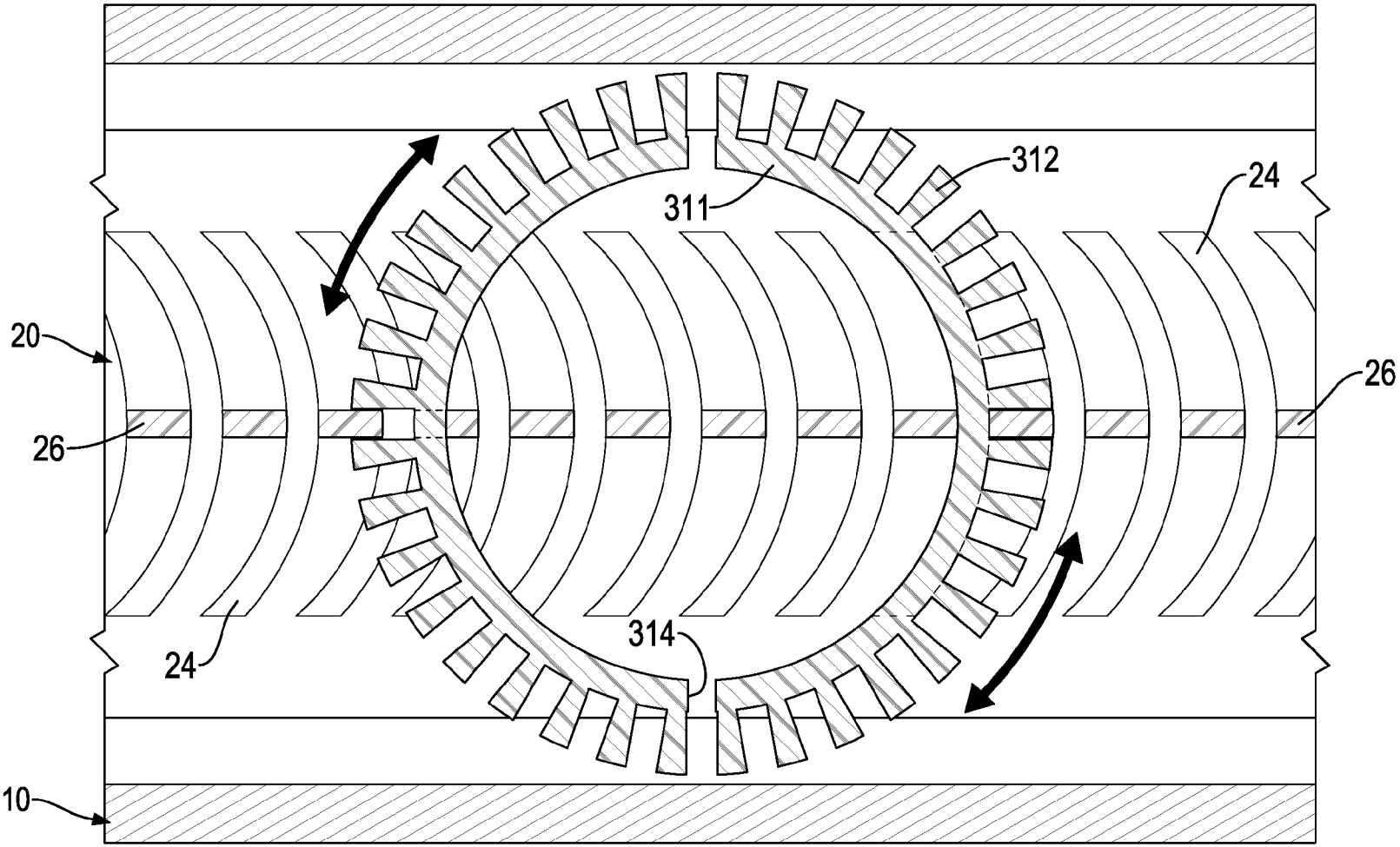
FIG. 11 is an operational top view in partial section of the tool holding frame along the line 11-11 in FIG. 10.
Figure 12:
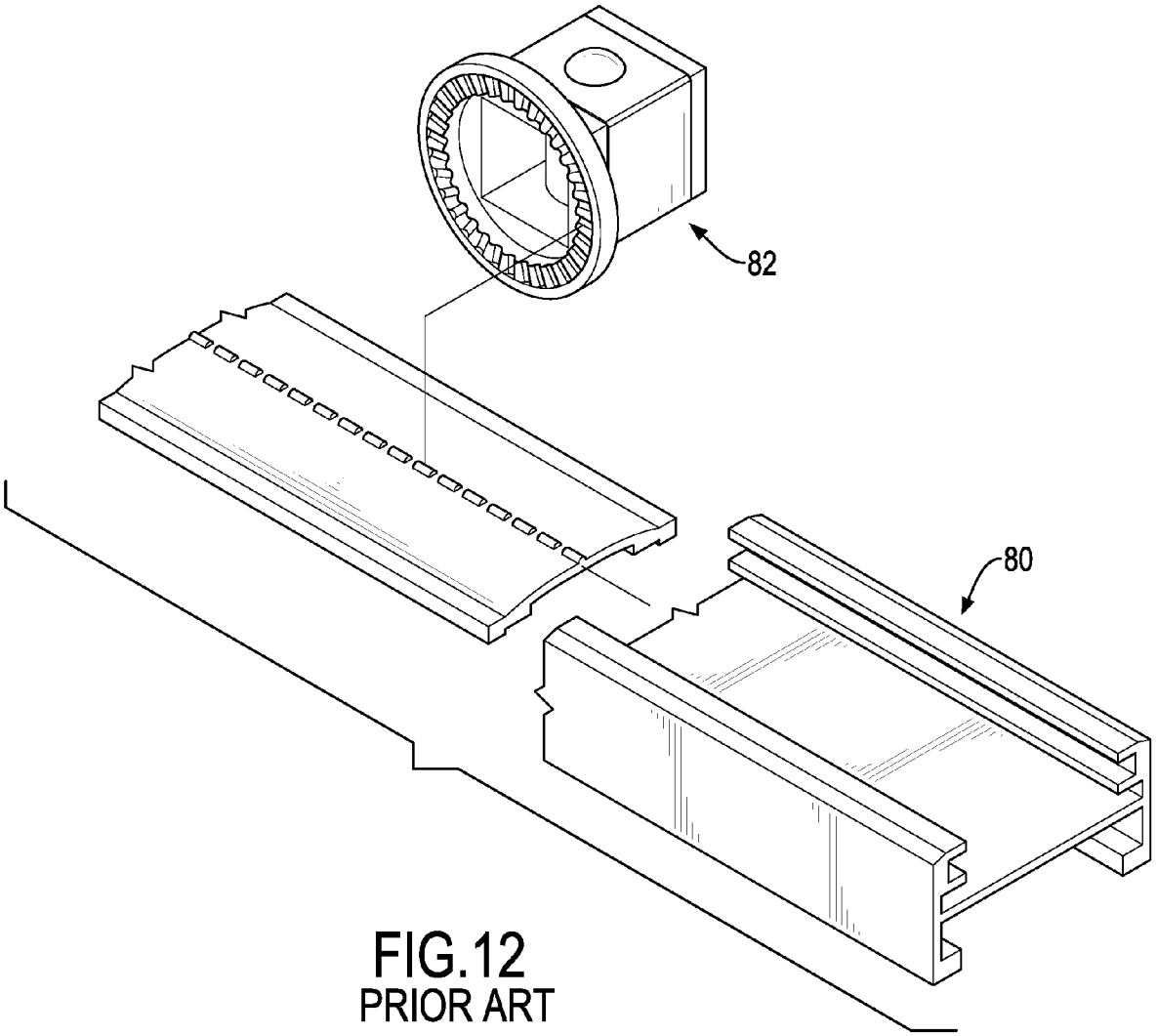
FIG.12 PRIOR ART
FIG. 12 is an exploded perspective view of a conventional socket holding frame.

When numbers or signs on the sockets 60 are not aligned at a same direction to face a user, the user may rotate the sockets 60 in a clockwise or counterclockwise direction relative to the track base 10 to make the numbers or signs of the sockets 60 face the user. With reference to FIGS. 9 to 11, during the above-mentioned rotating process, the sliding seats 31 of the positioning mounts 30 may be rotated with the sockets 60 relative to the positioning board 20 by the engagement between the extending elements 32 of the positioning mounts 30 and the sockets 60. When the socket 60 is rotated, the adjacent two of the second engaging segments 312 will be engaged and disengaged from the corresponding first engaging segment 26 due to the resilience of the engaging flange 311 of the positioning mount 30 or the positioning board 20. When the socket 60 is rotated to a desired angle, another adjacent two of the second engaging segments 312 will engage with the corresponding first engaging segment 26. The positioning mount 30 can be firmly positioned in rotation relative to the track base 10 to make the numbers or signs on the sockets 60 face the user.

To change the position of the positioning mount 30, the positioning mount 30 is rotated to align the guiding groove 314 in the positioning mount 30 with the first engaging segments 26. Consequently, the positioning mount 30 can be slid rapidly along the track base 10 to a desired position to fit with different usage demands.

In addition, to conveniently move or rotate the positioning mount 30, at least one or both of the positioning board 20 and the sliding seats 31 of the positioning mounts 30 is/are resilient. Accordingly, the second engaging segments 312 can be easily engaged with or disengaged from the first engaging segments 26. Thus, to move or to rotate the positioning mount 30 is easy and convenient.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A tool holding frame comprising:

a track base being an elongated seat and having a bottom panel being elongated and having a top surface;

two rails disposed respectively on two sides of the top surface of the bottom panel, each one of the two rails having a sliding channel having an opening, and the two openings of two sliding channels of the two rails facing each other;

a positioning board disposed on the track base and having two long opposite sides;

a middle;

a top surface;

multiple positioning segments formed on the top surface of the positioning board at spaced intervals and aligned in a straight line, and each positioning segment comprising a curved positioning groove; and multiple first engaging segments formed on and protruding from the top surface of the positioning board, aligned in a straight line, and arranged alternately with the positioning segments; and at least one positioning mount slidably and rotatably mounted on the track base, and each one of the at least one positioning mount having a sliding seat slidably and rotatably mounted in the sliding channels of the rails and having a bottom;

a top; and an annular positioning flange formed on and protruding downwardly from the bottom of the sliding seat and having a curved part selectively engaging with the curved positioning groove of one of the positioning segments on the positioning board;

multiple second engaging segments formed on the bottom of the sliding seat at spaced intervals and being arranged annularly, wherein adjacent two of the multiple second engaging segments are selectively engaged with one of the multiple first engaging segments on the positioning board; and a guiding groove defined in and extending diametrically through the bottom of the sliding seat; and an extending element formed on and protruding upwardly from the top of the sliding seat.

2. The tool holding frame as claimed in claim 1, wherein at least one of the positioning board and the at least one positioning mount is resilient.

3. The tool holding frame as claimed in claim 2, wherein each first engaging segment is arranged between middles of adjacent two of the positioning segments.

4. The tool holding frame as claimed in claim 3, wherein each rail of the track base further has a positioning channel located below the sliding channel of the rail and having an opening;

the openings of the positioning channels of the two rails face each other;

the positioning board is mounted in the positioning channels in the rails of the track base and further comprises a bottom surface;

two rail bars formed on and protruding outwardly from the bottom surface of the positioning board respectively at the two long opposite sides of the positioning board and mounted respectively in the positioning channels of the rails of the track base; and a recess formed in the bottom surface of the positioning board at the middle of the positioning board, the recess being parallel with the long opposite sides of the positioning board to form a space between the middle of the positioning board and the top surface of the bottom panel.

5. The tool holding frame as claimed in claim 4, wherein the curved positioning groove of each positioning segment has a depth gradually increasing from two ends to a middle of the curved positioning groove.

6. The tool holding frame as claimed in claim 1, wherein each first engaging segment is arranged between middles of adjacent two of the positioning segments.

7. The tool holding frame as claimed in claim 6, wherein each rail of the track base further has a positioning channel located below the sliding channel of the rail and having an opening;

the openings of the positioning channels of the two rails face each other;

the positioning board is mounted in the positioning channels in the rails of the track base and further comprises a bottom surface;

two rail bars formed on and protruding outwardly from the bottom surface of the positioning board respectively at the two long opposite sides of the positioning board and mounted respectively in the positioning channels of the rails of the track base; and a recess formed in the bottom surface of the positioning board at the middle of the positioning board, the recess being parallel with the long opposite sides of the positioning board to form a space between the middle of the positioning board and the top surface of the bottom panel.

8. The tool holding frame as claimed in claim 7, wherein the curved positioning groove of each positioning segment has a depth gradually increasing from two ends to a middle of the curved positioning groove.

9. The tool holding frame as claimed in claim 1, wherein the curved positioning groove of each positioning segment has a depth gradually increasing from two ends to a middle of the curved positioning groove.

* * * * *